US005878803A

United States Patent [19]

Kraeutler

[11] Patent Number: 5,878,803

[45] Date of Patent: Mar. 9, 1999

[54] GOODS-HANDLING DOOR

[76] Inventor: Bernard Kraeutler, La Villette, F-43220 Duniéres, France

[21] Appl. No.: 962,929

[22] Filed: Oct. 1, 1997

Related U.S. Application Data

[63] Continuation of Ser. No. 617,794, filed as PCT/FR94/01046 Sep. 4, 1994 published as WO95/07403 Mar. 16, 1995, abandoned.

[30] Foreign Application Priority Data

Sep. 8, 1993 [FR] France ..... 93 10650

[51] Int. Cl.[6] ..... A47H 3/00

[52] U.S. Cl. ..... 160/271; 160/195; 160/268.1

[58] Field of Search ..... 160/268.1, 273.1, 160/265, 270, 271, 272, 264, 322, 133, 194, 195, 238

[56] References Cited

U.S. PATENT DOCUMENTS

| | | | |
|---|---|---|---|
| 1,784,948 | 12/1930 | Rush . | |
| 2,322,088 | 6/1943 | Black | 160/195 |
| 2,323,612 | 7/1943 | Lombardi et al. | 160/195 X |
| 3,092,170 | 6/1963 | Ellis | 160/195 X |
| 4,016,920 | 4/1977 | Shepard | 160/194 X |
| 4,718,471 | 1/1988 | Kraeutler . | |
| 4,828,003 | 5/1989 | Kraeutler . | |
| 5,072,767 | 12/1991 | Kreautler . | |

FOREIGN PATENT DOCUMENTS

| | | |
|---|---|---|
| 1196095 | 11/1959 | France . |
| 1570742 | 6/1969 | France . |
| 2029880 | 3/1980 | United Kingdom . |
| 2033459 | 5/1980 | United Kingdom . |

OTHER PUBLICATIONS

Comprehensive Dictionary of Engineering and Technology, p. 1185, (no date).

*Primary Examiner*—Blair M. Johnson
*Attorney, Agent, or Firm*—Kenyon & Kenyon

[57] ABSTRACT

A goods-handling door for closing or opening a bay formed in a wall, said door comprising: a raisable curtain (3) capable of being collected together at the top of the door; a vertical slideway (5) on either side of the curtain, each slideway being suitable for receiving a respective side edge of the curtain and having a face placed against the wall at the edge of the bay, the side edges of the curtain being adapted to slide in said side vertical slideways to hold the curtain substantially in the plane of the door; and mechanical means for operating the door, the mechanical means comprising a shaft (4) disposed at the top of the door for winding up the curtain or curtain-raising straps, a motor (104) for driving said shaft, an end-of-stroke device (105), and control means (106), said door being characterized in that each slideway is fixed in position by disengageable means (9) to hold the slideway in the plane of the door during normal operation thereof while allowing the slideway to leave its location when sufficient force is exerted thereon.

12 Claims, 4 Drawing Sheets

GOODS-HANDLING DOOR

This application is a continuation, of application Ser. No. 08/617,794, filed as PCT/FR94/01046 Sep. 4, 1994 published as WO95/07403 Mar. 16, 1995.

Background of the Invention

The present invention relates to a "goods-handling" door for an industrial building such as a factory, a workshop, a warehouse, a hangar, or the like, to enable a bay cut out in a wall to be closed or opened.

A door of this type comprises a curtain that must be capable of being raised and lowered quickly to allow vehicles to pass through, while remaining open as short a time as possible so as to restrict the passage of noise and air between two premises or between the inside and the outside. The curtain is flexible or made up of rigid panels, and it is capable of being wound up or folded up at the top of the door. The curtain may optionally be reinforced by horizontal stiffening bars. At its top, the door includes mechanical members: a motor, a shaft for winding up the curtain or curtain-raising straps, a stepdown gear box, end-of-stroke detector means, etc. . . . . Slideways are provided on either side of the door to guide the edges of the curtain, and optionally also the ends of stiffening bars. The slideways may optionally form vertical side uprights with the mechanical elements being fixed to the tops thereof. The tops of the uprights may be interconnected by a top cross-beam. The beam may also be fixed to the wall, above the door or on either side thereof.

The uprights are usually placed against the wall, at the edges of the opening constituted by the bay, and they may optionally be within the opening in the thickness of the wall, against the end section thereof. This disposition is uncommon since it reduces the available area in the opening.

In certain industries, such as the pharmaceutical, food, chemical, etc. industries, it is necessary to clean the elements of the door completely on a regular basis. Unfortunately, it is not possible to clean the gap between one of the sides of an upright and the portion of the wall against which it is placed. An object of the present invention is to enable such cleaning to be performed completely.

When a vehicle comes up to the door, the curtain is generally raised automatically and the vehicle can pass through almost without slowing down, with the door closing again after the vehicle has gone through. Nevertheless, it can happen that the vehicle is travelling too fast, and that it strikes the curtain before it has been raised far enough. Means and dispositions have already been proposed to limit the physical damage suffered by the door under such circumstances. In one proposal, the slideways may be flexible, allowing the curtain to escape if excessive force is applied thereto (European patent EP-0 272 733 ). In another proposal, the stiffening bars of the curtain may be flexible, so they flex to escape from the slideways if they are subjected to too great a force (EP-0 398 791 ). Hinged doors have also been proposed in which the hinges come undone if they are subjected to too much force (FR-1 196 095 ).

Summary of the Invention

It can also happen that a vehicle passing through the door strikes the slideways. They can then be deformed and jam the edge of the curtain which can no longer operate. A first object of the invention is to provide means for limiting damage under such circumstances, in order to avoid the door being taken out of service. If a door is taken out of service in this way, production in a workshop often needs to be interrupted until the door has been repaired. Another object of the invention is to eliminate or reduce damage under such circumstances.

To this end, the invention provides a goods-handling door for closing or opening a bay formed in a wall, said door comprising: a raisable curtain capable of being collected together at the top of the door; a vertical slideway on either side of the curtain, each slideway being suitable for receiving a respective side edge of the curtain, the side edges of the curtain being adapted to slide in said side vertical slideways to hold the curtain substantially in the plane of the door; and mechanical means for operating the door, the mechanical means comprising a shaft disposed at the top of the door for winding up the curtain or curtain-raising straps, a motor for driving said shaft, an end-of-stroke device, and control means, each slideway being fixed in the operating position by disengageable means, said door being characterized in that in the operating position each slideway has a face placed against the wall at the edge of the bay, in such a manner that when the slideways are disengaged, the surfaces of the wall and the slideway faces which are otherwise placed against each other are released in part.

In an advantageous embodiment, the fixing of each slideway includes disengageable holding means and a hinge allowing at least a portion of the slideway to rotate away from the plane of the door.

Thus, by swinging over the slideway it is possible to disengage the slideway for repairing or cleaning the face of the slideway that it applied to the wall, and also the flat of the wall against which it is applied. It is generally the bottom portion that picks up most dirt, but clearly the entire slideway can be swung away from its working position. The slideway can be disengaged by an appropriate control mechanism.

Similarly, when a vehicle strikes one of the slideways in clumsy manner, the slideway escapes from its disengageable support. In most cases, disengagement of the slideway does not damage the curtain which is adapted to slide in the slideways. When a vehicle reaches the door, the curtain is usually already more or less fully raised and thus disengaged from the slideways. Thus, when the slideway falls it is not in any risk of taking the curtain with it, so the curtain is not damaged. Slideways mounted in this manner, i.e. releasably, thus constitute a kind of undeformable bumper for the door. By re-engaging the slideway on its disengageable support provided on the wall or on the ground, or on the doorframe components, or on all three, the door can be put back into its original working condition.

By connecting the slideway to a fixed structure via a hinge, it is prevented from falling to the ground once removed from its disengageable holding means. A falling slideway could injure someone, particularly if the door is of considerable height. With a hinge, the slideway, or at least the disengaged rotary portion thereof, naturally returns to the plane of the door under the effect of gravity. This facilities putting the door back into operation, given that the slideway remains properly positioned relative to its disengageable holding means. A shock against a slideway will have the effect of causing it to pivot about its hinge point. This simple means serves to avoid any risk of accident and facilitates re-engagement of the slideway in its disengageable support.

In a satisfactory embodiment, the hinge is situated at the top end of the rotary portion of the slideway, and the disengageable means is situated at the bottom end of the rotary portion of the slideway.

In an embodiment of the invention, only a portion of the slideway is hinged and provided with disengageable holding means, which portion is preferably its bottom portion since that is the portion most exposed to dirt and to shocks from vehicles. The top portion of the slideway is fixed against the wall or to doorframe elements, e.g. a bracket fixed to the wall. The hinge joins the fixed top portion to the rotary bottom portion. Even when the rotary bottom portion is no longer in the plane of the door, the slideway defines a continuous guide for the edges of the curtain. The slideway is bent at the hinge but it remains uninterrupted.

In a particularly advantageous embodiment, the slideway is formed as a single piece, the hinge being situated at the top end of the slideway and the disengageable holding means at its bottom end.

In practice, this is the simplest embodiment: each slideway is kept in the plane of the door via two points situated at respective ends thereof. The hinge may bear against the top portion while the holding means are fixed to the ground. This provides good stability to the slideway and makes disengagement easy.

In a practical embodiment, the disengageable holding means consist in a ball placed on the slideway, and urged away from the slideway by resilient means to co-operate with a housing fixed on the ground, said ball being adapted to escape from said housing under the effect of a shock, by the ball being pressed back against said resilient means.

In another practical embodiment, the holding means consist in a magnet secured to one of the slideway and the ground, and a ferromagnetic mass secured to the other, the magnet and the mass facing each other when the slideway is in its normal operating position.

The slideway may be a channel-section bar with its side walls being extended at said hinge by curved portions inserted in an outlet guide of the top structure.

The circularly arcuate curved portions enable the slideway to rotate without leaving a gap at the hinge. The hinge point is engaged in the outlet guide of the top structure and the curved portions surround it like a ball-and-socket joint.

Other characteristics and advantages of the invention appear from the following description given by way of non-limiting example and made with reference to the accompanying drawings, serving to make it understood how the invention can be implemented.

BRIEF DESCRIPTION OF THE DRAWINGS P In the drawings.

Figure 5:
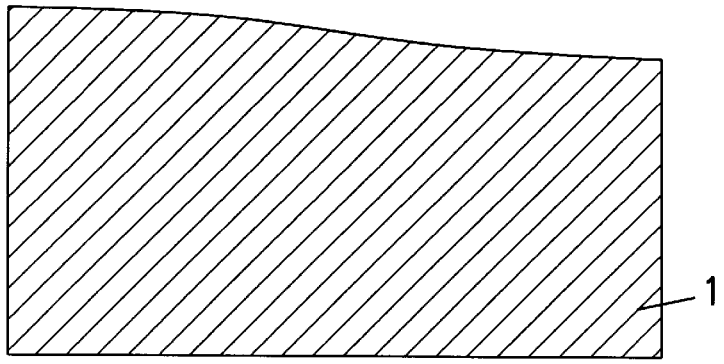
FIG. 5 is a section on a horizontal plane on line V—V of FIG. 1, through a slideway provided with an engagement piece for fixing the slideway in co-operation with the piece of FIGS. 3 and 4.
Figure 8:
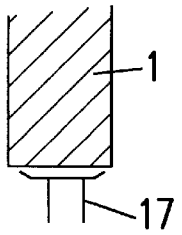
Figure 9:
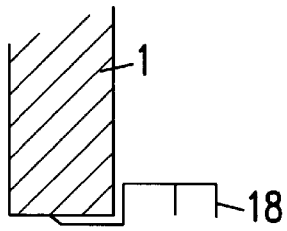
Figure 10:
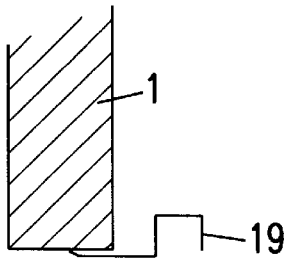
Figure 11:
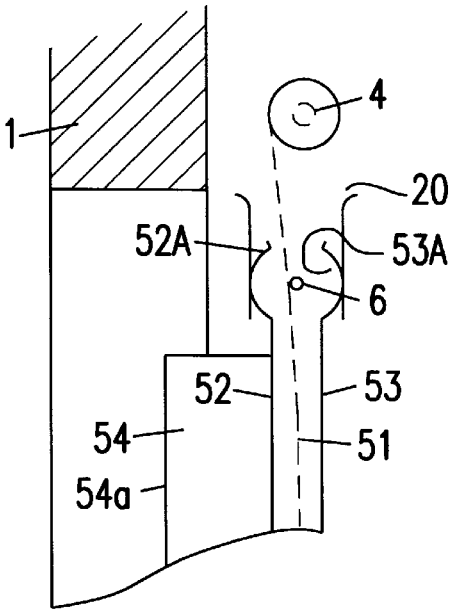
Figure 12:
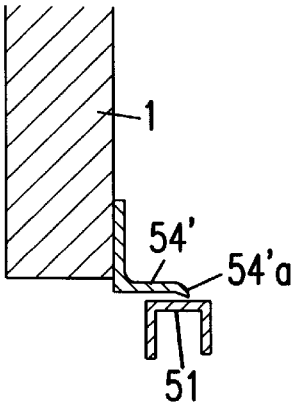

FIGS. 8, 9, and 10 are section views on a horizontal plane, analogous to FIG. 5, but for slideways of different right cross-sections;

FIG. 11 is a diagrammatic section view of an embodiment of the invention; and FIG. 12 is a diagrammatic section view of a variant embodiment of a slideway.

DETAILED DESCRIPTION OF THE INVENTION

FIGS. 1 to 5 show an example of a door of the invention. A bay 2 is cut out in a wall 1. In the example shown, the door includes a flexible curtain 3 suitable for being wound around a shaft 4 disposed above the bay. On either side of the bay, at the top thereof, there is fixed a doorframe element. In an advantageous embodiment of the present invention, each doorframe element is in the form of a bracket 10 having a first flange fixed against the wall and a second flange perpendicular to the first. The second flange 102G of the left bracket 10G (in FIG. 1) carries a first bearing 103, and the second flange 102D of the right bracket 10D carries a second bearing. The shaft 4 is carried by these two bearings. In an advantageous disposition of the present invention, one of the brackets (the bracket on the left) carries the bearing only, while the other bracket also carries all of the electrical control members and the mechanical members for driving the shaft: an electric motor 104, generally together with a stepdown gear box and an incorporated brake; an end-of-stroke device 105; and various relays and other electrical members 106. This disposition makes it possible to prefabricate the door and makes delivery and installation very simple, thereby greatly reducing the cost of such a door.

The curtain shown can be wound directly onto the shaft 4. The invention is equally applicable if a rigid or flexible curtain is provided that is raised by straps that are themselves wound onto the shaft 4, while the curtain folds up at the top of the door. When the curtain 3 is wound down it closes the bay. Given that the shaft 4 is placed against the wall and above the bay, the curtain moves down in front of the bay. If the shaft is placed within the bay, then the curtain moves down inside the bay, in the thickness of the wall. This disposition requires a larger bay for the same area of opening since the door members occupy part of the bay. Sufficient height must be provided when the building is built, and that assumes foreknowledge of the type of door that is to be installed in the bay. That is why this disposition is selected less frequently. Nevertheless, the present invention is highly applicable thereto.

Slideways 5 are disposed on the sides of the bay to receive and guide the edges of the curtain while the curtain is moving up and down, and also to hold the curtain when it is down against pressure from wind or drafts.

In the example shown, the slideways are disposed in front of the plane of the wall (see FIG. 2) to receive the curtain directly. In addition, in this example, the slideways are placed inside the outline of the bay when the bay is seen in front view, for reasons that are explained below.

As can be seen in FIG. 5, which is a section view through such a slideway on a horizontal plane, the section of the slideway is approximately F-shaped. The slideway proper within which the edge of the curtain slides comprises a web 51 and two flanges 52 and 53 whose edges may be flared, as shown. In this example, the slideway has a third flange 54 for draft-proofing purposes that extends the web and serves to draft-proof the door by closing the space between the curtain and the wall 1. The slideway may be made of any suitable material: bent and welded sheet metal; extruded aluminum or plastic; etc. The third flange 54 has a free edge 54*a* which advantageously curves out for draft-proofing. In a variant, the draft-proofing flange 54 may be separate from the slideway and fixed to the wall (FIG. 12), in which case the free edge 54*a* projects to the right from the wall and co-operates for draft-proofing with the web 51 of the slideway.

An object of the invention is to make thorough cleaning possible, at least of the bottom portions of the door which are exposed to dust and splashing. In presently-used dispositions, the slideway is placed against the wall via one of its faces (51, 52, or 53), and it is fixed at top and at bottom, and possibly also at intermediate points. There thus exists a narrow gap between the wall and the face of the slideway in which dirt and bacteria can accumulate. Although that does not matter in certain workshops, it is unacceptable in warehouses for food or pharmaceuticals, for example. Another object of the invention is also to avoid a slideway being destroyed by the shock of a vehicle, a truck, or a cart striking it, due to a mistake by the driver.

To this end, the slideway is fixed so that it can easily be moved away from its working position. It may be fixed by snap-fastening or by engagement. This enables staff to disengage it instantly, to clean the locations that are not accessible in normal operation, and then to put it back into place. In an advantageous embodiment of the present invention, fixing by snap-fastening may be performed so as to enable the slideway to escape from its position if it receives a shock, or excessive thrust, so as to prevent it being crushed, twisted, or broken, and so as to prevent it from jamming the curtain which would then no longer be movable. In the example shown, the slideway remains fixed at its top portion via a hinge 6 about which it can swing. In this example, the hinge 6 is formed on a bracket 102 which is itself fixed to the wall 1. The bottom portion of the slideway is fixed in a disengageable fixing. In this example, the disengageable fixing is constituted by a tip, more specifically a ball 7, that co-operates with a housing 8 formed by a cavity in a base piece 9. The ball 7 is loaded by a spring 11.

Figure 3:
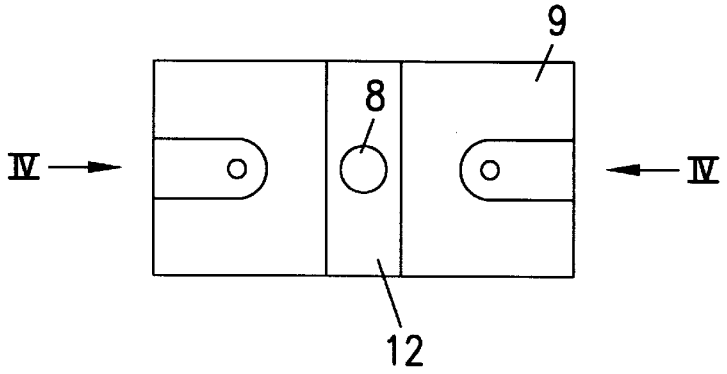
FIG. 3 is a plan view of one example of a fixing piece for the door of the invention.
Figure 4:
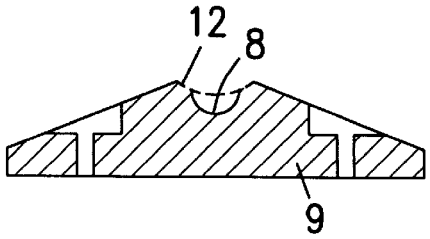
FIG. 4 is a section on a vertical plane on line IV—IV of FIG. 3.
Figure 6:
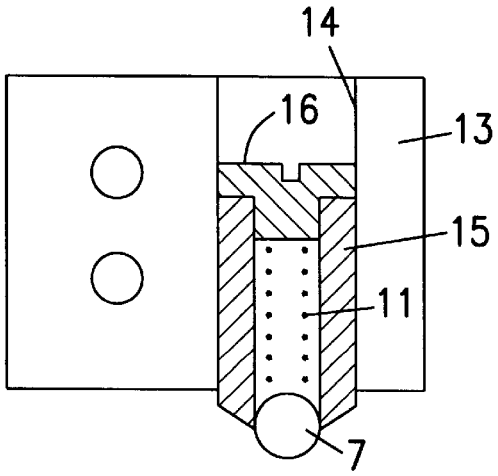
FIG. 6 is a section view through the FIG. 5 engagement piece on a vertical plane on line VI—VI of FIG. 5.

A base piece is shown in FIGS. 3 and 4. It is provided with a groove 12 extending in the same plane as the curtain; in the groove there is a cavity 8 designed to receive the retaining ball 7. On either side of the groove, there are provided slopes for guiding the ball in its approach when the slideway is put back into place, and fixing holes for fixing to the ground may be provided within these slopes.

To fix the bottom end of the slideway, an engagement piece 13 containing the ball 7 and the spring 11 is fixed to the foot of the slideway against the draft-proofing flange 54 and thus away from the path followed by the curtain which is between the flanges 52 and 53, thereby not impeding movement of the curtain. Such a piece is commercially available and comprises a fixing portion having bores for receiving bolts and a threaded well 14 in which a socket 15 is screwed that contains the spring 11 and the ball 7, with the ball projecting through a bottom opening of the socket, and with the well also receiving a plug 16 for adjusting the compression of the spring.

Figure 7:
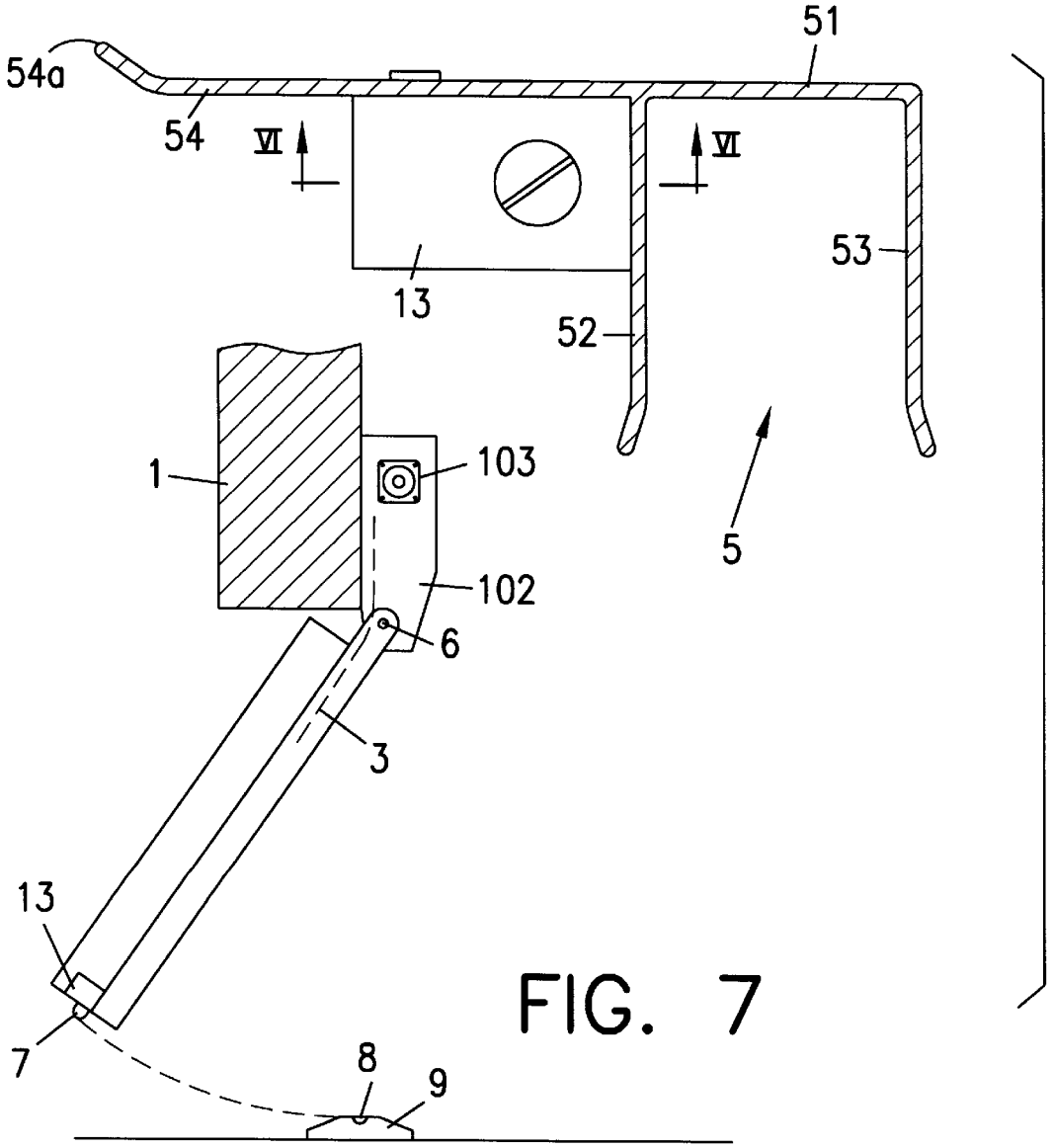
FIG. 7 is a view corresponding to FIG. 2 with a slideway disengaged from its normal position for cleaning purposes.

In the event of an excessive shock against the slideway, it disengages the bottom fixing and it swings about the hinge 6. This prevents damage both to the slideway and to the curtain, as can be seen in FIG. 7 where the curtain is represented by dashed lines.

The disengageable fixing may also be in the form of a magnet mounted at the bottom end of the slideway, replacing the ball. When the slideway is in its normal state in the plane of the door, the magnet faces a ferromagnetic mass responsive to the properties of the magnet. By using a magnet it is possible for the slideway to return automatically into the plane of the door without the need for any person to intervene. By using a magnet of sufficient power, the desired objective can be achieved. The positions of the ball and of the engagement piece may be interchanged, as may the magnet and the magnetic mass. The disengageable fixing may be provided in a horizontal plane beneath the slideway or on the side thereof adjacent to its bottom portion. Means such as a lever may be provided to disengage the slideway from its bottom fixing.

A top fixing in the form of a hinge, as shown in the figures, enables the slideway to escape from its position while still protecting the curtain if it is down. Other kinds of fixing are possible, including disengageable fixing. It may be observed that one of the slideways will receive a shock when a vehicle is going through, i.e. when the curtain is up, so there is little risk, in practice, of damaging the curtain.

It may be observed that there exist numerous engagement or snap-fastening systems and that the systems described above are given by way of non-limiting example. The object of the invention is to provide a disengageable system for holding the slideway in the plane of the door.

In both examples described, the fixing points are situated at the ends of the slideway: that constitutes a disposition that is simple and convenient. Nevertheless, the fixing points could be located elsewhere. The slideway could be fitted with a longitudinal rib engaged and held resiliently in a vertical slot. Under shock or applied pressure, the slideway would disengage.

It is possible that the slideway would escape not because of a shock against the slideway but because of a shock or pressure applied to the curtain while closed. In which case the slideway can be entrained by the curtain without the curtain being torn.

FIG. 8 is a diagrammatic section showing one form of slideway 17 placed in line with the wall 1. It operates in the same way as that described above.

Figure 1:
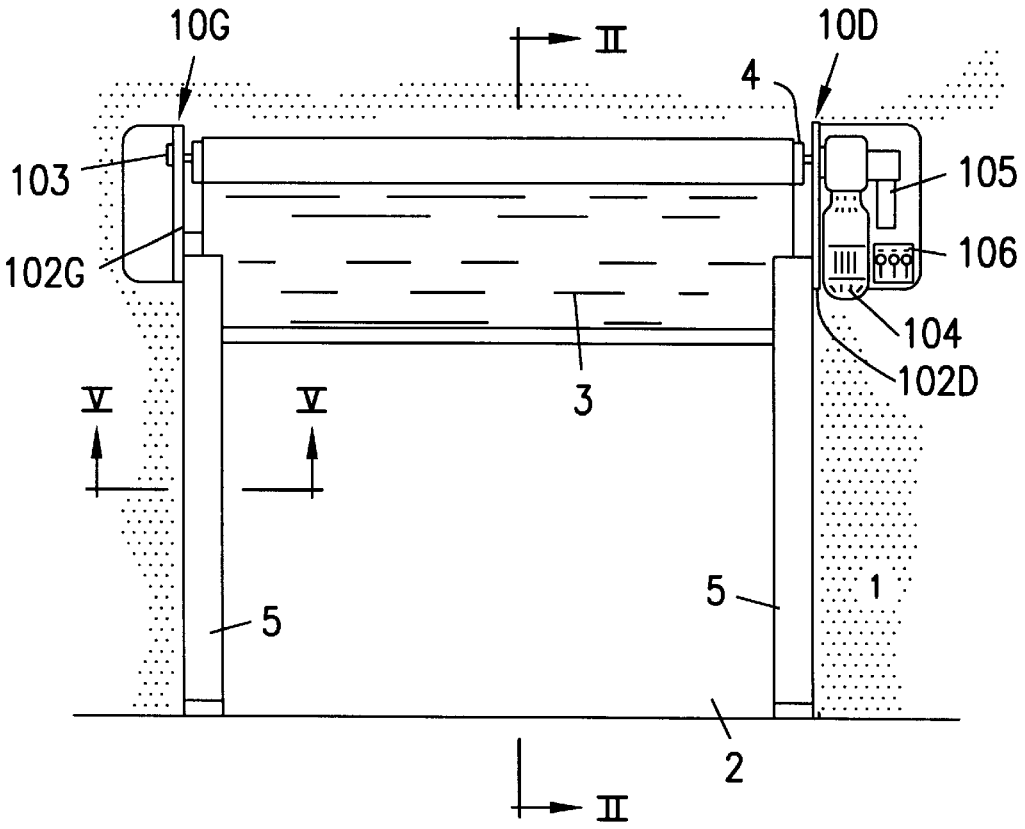
FIG. 1 is a front view of a door of the present invention designed to open or close a bay formed in a wall.
Figure 2:
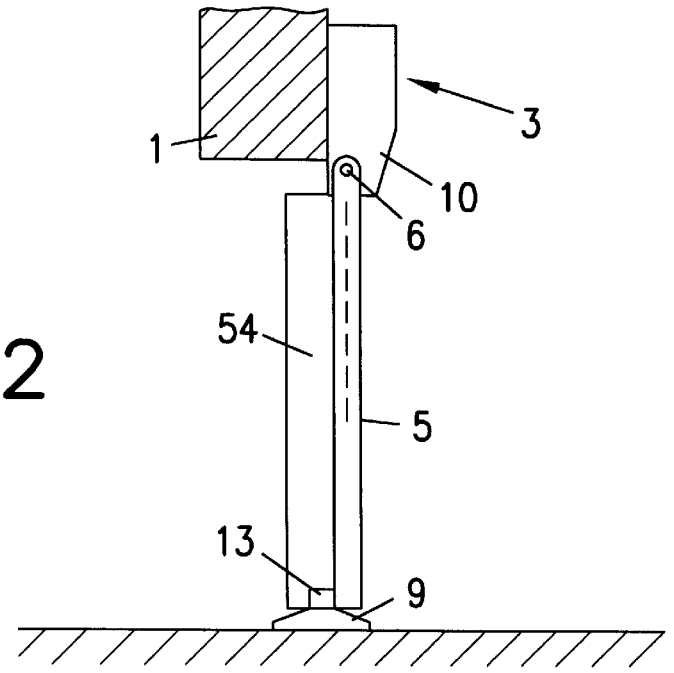
FIG. 2 is a section view on a vertical plane on line II—II of FIG. 1.

It will be understood that the slideway 18 of FIG. 9 can escape in one direction only, i.e. to the right in FIG. 2, whereas the slideway 19 in FIG. 10 can escape normally to the right only, but also to a very limited extent to the left. In both cases, the advantage remains of being able to displace the slideway by hand for repair of cleaning purposes. The slideway of FIG. 12 corresponds to the case where the draft-proofing flange 54' is fixed to the wall and has a free edge 54' a for achieving draft-proof sealing against the slideway, possibly in association with an appropriate gasket. The flange 54 may be secured at its top to the doorframe element which supports the wind-up shaft and it may participate in supporting it.

To improve protection of the curtain and to guarantee that it can move even when the slideway is disengaged, it is possible to make a slideway that includes a top portion that is fixed and a bottom portion that is hinged (FIG. 11) with a continuous junction between the edges of the side walls 52 and 53 of the bottom portion of the slideway and the fixed top portion 20 with said side walls 52 and 53 being extended by curved portions 52A and 53A. This disposition allows the slideway to swing without leaving any gaps. The two cylindrical extensions 52A and 53A of the walls 52 and 53 rotate inside the fixed slideway 20.

What is claimed is:

1. A goods-handling door in combination with a wall which defines a bay opening therein, the door being disposed in the bay opening for closing or opening the bay opening, the door comprising:

a raisable curtain capable of being collected together at a top of the door;

a vertical slideway on either side of the curtain, each slideway being suitable for receiving a respective side edge of the curtain, the side edges of the curtain being adapted to slide in the side vertical slideways to hold the curtain substantially in a plane of the door;

mechanical means for operating the door, the mechanical means comprising a shaft disposed at the top of the door for raising the curtain, a motor for driving the shaft, an end-of-stroke device and control means, each slideway being fixed in an operating position by disengaging means; and first and second doorframe elements positioned at the top of the door and disposed on either side thereof, wherein the shaft is carried by first and second bearings which are disposed on the respective first and second doorframe elements, wherein, in the operating position, each slideway has a face placed against the wall at the edge of the bay so that when the slideways are disengaged, the surfaces of the wall and the slideway faces which are otherwise placed against each other are at least partially released, and wherein the disengaging means are independently and releasably coupled to respective one of the slideways so that at least one of the slideways disengages from the disengaging means without damaging the disengaging means when a thrust is applied to at least one of the slideways and the raisable curtain.

2. The goods-handling door according to claim 1, further comprising:

disengageable holding means for fixing each slideway in the operating position; and a hinge allowing at least a portion of the slideway to rotate away from the plane of the door.

3. The goods-handling door according to claim 2, wherein the hinge is situated at a top end of a rotary portion of the slideway, and wherein the disengageable means is situated at a bottom end of the rotary portion of the slideway.

4. The goods-handling door according to claim 2, wherein the slideway is formed as a single piece, the hinge being situated at a top end of the slideway and the disengageable holding means at a bottom end of the slideway.

5. The goods-handling door according to claim 1, wherein the disengageable holding means include a ball placed on the slideway, and urged away from the slideway by resilient means to co-operate with a housing, the housing being fixed on ground, the ball being adapted to escape from the housing under an effect of the thrust by the ball being pressed back against the resilient means.

6. The goods-handling door according to claim 1, wherein the doorframe element is a bracket.

7. The goods-handling door according to claim 1, wherein one of the first and second doorframe elements carries the first bearing, and another one of the first and second doorframe elements carries the second bearing, an electric motor for actuating the shaft, the end-of-stroke device, and the control means for controlling the motor.

8. The goods-handling door according to claim 7, further comprising a stepdown gear box associated with the electric motor.

9. The goods-handling door according to claim 1, wherein the disengageable means include further means for providing draft-proofing means relative to a fixed wall surrounding the door.

10. The goods-handling door according to claim 9, wherein the draft-proofing means comprises a flange having an edge along the slideway, the flange having a free edge being pressed along the fixed wall surrounding the door.

11. The goods-handling door according to claim 9, wherein the draft-proofing means includes a flange fixed to the wall, the flange having a free edge designed to cooperate with the slideway to provide draft-proofing.

12. The goods-handling door according to claim 1, further comprising a control mechanism for voluntarily disengaging the slideway.

* * * * *